US010433615B2

(12) United States Patent
Park et al.

(10) Patent No.: US 10,433,615 B2
(45) Date of Patent: Oct. 8, 2019

(54) SOLE FOR DISPERSING PRESSURE OF MIDFOOT AND METATARSAL BONES AND SHOE HAVING SAME

(71) Applicants: In Sik Park, Seoul (KR); Eugene David Park, Seoul (KR)

(72) Inventors: In Sik Park, Seoul (KR); Eugene David Park, Seoul (KR)

(73) Assignees: In Sik Park (KR); Eugene David Park (KR)

( * ) Notice: Subject to any disclaimer, the term of this patent is extended or adjusted under 35 U.S.C. 154(b) by 169 days.

(21) Appl. No.: 15/348,295

(22) Filed: Nov. 10, 2016

(65) Prior Publication Data

US 2017/0055635 A1 Mar. 2, 2017

Related U.S. Application Data

(63) Continuation of application No. 15/090,780, filed on Apr. 5, 2016, now abandoned, and a continuation of (Continued)

(30) Foreign Application Priority Data

Oct. 14, 2013 (KR) ..... 10-2013-0121700

(51) Int. Cl.
*A43B 13/18* (2006.01)
*A43B 13/14* (2006.01)

(Continued)

(52) U.S. Cl.
CPC ..... *A43B 13/184* (2013.01); *A43B 1/0072* (2013.01); *A43B 7/149* (2013.01);

(Continued)

(58) Field of Classification Search
CPC ... A43B 13/184; A43B 13/223; A43B 13/125; A43B 13/186; A43B 7/149;

(Continued)

(56) References Cited

U.S. PATENT DOCUMENTS 1,189,329 A * 7/1916 Winagle ..... A43B 23/227 36/136
1,633,324 A * 6/1927 Hartung ..... A43B 13/184 36/36 R (Continued)

FOREIGN PATENT DOCUMENTS

KR 10-2000-0036859 A 7/2000
KR 10-2010-0042863 A 4/2010

(Continued)

OTHER PUBLICATIONS

International Search Report(PCT/KR2014/009638), WIPO, dated Jan. 28, 2015.

(Continued)

*Primary Examiner* — Katharine Gracz
(74) *Attorney, Agent, or Firm* — Park & Associates IP Law, P.C.

(57) ABSTRACT

The present invention relates to a midsole for dispersing the pressure of the mesopodium and the metatarsal bones, and a shoe having the same, the midsole having, installed in a metatarsal bone portion and mesopodium portion of the central upper part thereof, a midfoot support for receiving an inner sole, which protrudes upwardly so as to support the mesopodium, and having a bridge groove formed in a metatarsal bone portion of the lower part thereof, wherein the bridge groove consists of three components, and has been improved so as to be capable of supporting joints between the metatarsal bone body and basal tarsus metatarsal bones.

7 Claims, 8 Drawing Sheets

Related U.S. Application Data application No. PCT/KR2014/009638, filed on Oct. 14, 2014.

(51) Int. Cl.

| | |
|---|---|
| ***A43B 7/22*** | (2006.01) |
| ***A43B 13/38*** | (2006.01) |
| ***A43B 1/00*** | (2006.01) |
| ***A43B 7/14*** | (2006.01) |
| ***A43B 13/12*** | (2006.01) |
| ***A43B 13/22*** | (2006.01) |

(52) U.S. Cl.

CPC ..... *A43B 7/1445* (2013.01); *A43B 7/1465* (2013.01); *A43B 7/22* (2013.01); *A43B 13/125* (2013.01); *A43B 13/14* (2013.01); *A43B 13/145* (2013.01); *A43B 13/186* (2013.01); *A43B 13/223* (2013.01); *A43B 13/38* (2013.01)

(58) Field of Classification Search

CPC ..... A43B 7/1465; A43B 13/14; A43B 7/1445; A43B 1/0072; A43B 13/38; A43B 7/22; A43B 13/145

See application file for complete search history.

(56) References Cited

U.S. PATENT DOCUMENTS

| | | | | | | |
|---|---|---|---|---|---|---|
| 2,095,488 | A | * | 10/1937 | Cobb | A43B 13/145 | 36/149 |
| 2,311,925 | A | * | 2/1943 | Boos | A43B 7/142 | 36/163 |
| 2,510,654 | A | * | 6/1950 | Pepin | A43B 7/1415 | 36/155 |
| 2,884,717 | A | * | 5/1959 | Goldberg | A43B 13/143 | 36/169 |
| 3,198,192 | A | * | 8/1965 | O'Brien | A61F 5/0195 | 602/10 |
| 3,494,355 | A | * | 2/1970 | Wolpow | A61F 13/041 | 602/10 |
| 3,680,550 | A | * | 8/1972 | Tunstall | A61F 13/045 | 602/10 |
| 3,744,487 | A | * | 7/1973 | Lipson | A61F 2/66 | 602/10 |
| 3,916,538 | A | * | 11/1975 | Loseff | A61F 13/045 | 36/11.5 |
| 4,262,433 | A | * | 4/1981 | Hagg | A43B 13/143 | 36/25 R |
| 4,316,333 | A | * | 2/1982 | Rothschild | A43B 7/142 | 36/50.1 |
| 4,360,011 | A | * | 11/1982 | Lewis, Jr. | A61F 13/045 | 602/10 |
| 4,372,059 | A | * | 2/1983 | Ambrose | A43B 7/146 | 36/103 |
| 4,821,432 | A | * | 4/1989 | Reiber | A43B 7/1465 | 36/110 |
| 5,070,867 | A | * | 12/1991 | March | A61F 3/00 | 36/136 |
| 5,170,574 | A | * | 12/1992 | Weisbrich | A43B 5/006 | 36/131 |
| 5,921,009 | A | * | 7/1999 | Hice | A43B 13/143 | 36/140 |
| 5,974,699 | A | * | 11/1999 | Park | A43B 13/148 | 36/103 |
| 6,311,416 | B1 | * | 11/2001 | Cohen | A43B 7/00 | 36/115 |
| 6,349,487 | B1 | * | 2/2002 | Hice | A43B 13/143 | 36/140 |
| D488,915 | S | * | 4/2004 | Girbaud | A43B 13/145 | D2/951 |
| 6,792,703 | B2 | * | 9/2004 | Cohen | A43B 7/00 | 36/115 |
| 7,500,324 | B1 | * | 3/2009 | Power | A43B 13/145 | 36/132 |
| 2005/0235526 | A1 | * | 10/2005 | Kim | A43B 7/1465 | 36/91 |
| 2006/0130364 | A1 | * | 6/2006 | Greene | A43B 3/24 | 36/28 |
| 2009/0193687 | A1 | * | 8/2009 | Kim | A43B 5/00 | 36/103 |
| 2010/0236094 | A1 | * | 9/2010 | Ryu | A43B 7/24 | 36/28 |
| 2010/0275460 | A1 | * | 11/2010 | Ha | A43B 7/142 | 36/28 |
| 2011/0126422 | A1 | * | 6/2011 | Vattes | A43B 7/144 | 36/10 |
| 2011/0289798 | A1 | * | 12/2011 | Jung | A43B 7/142 | 36/91 |

FOREIGN PATENT DOCUMENTS

| | | | |
|---|---|---|---|
| KR | 10-2010-0119986 | A | 11/2010 |
| KR | 20-0454043 | Y1 | 6/2011 |
| KR | 10-1073810 | B1 | 10/2011 |
| KR | 10-2011-0127058 | A | 11/2011 |
| KR | 10-2011-0127087 | A | 11/2011 |
| KR | 10-2013-0025050 | A | 3/2013 |
| KR | 20-0468144 | Y1 | 7/2013 |

OTHER PUBLICATIONS

European Search Report(EP 14-85-4450), European Patent Office, dated Sep. 28, 2016.

* cited by examiner

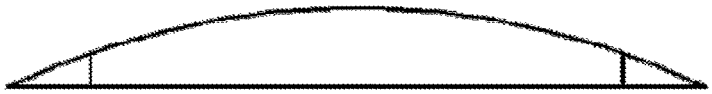
FIG. 6B
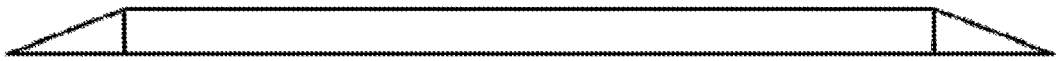
FIG. 7A
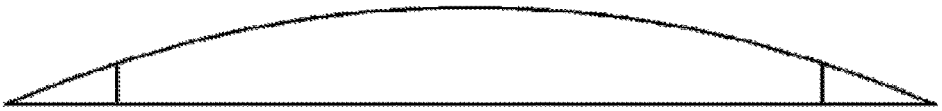
FIG. 7B (Same as FIG. 6B)

SOLE FOR DISPERSING PRESSURE OF MIDFOOT AND METATARSAL BONES AND SHOE HAVING SAME

REFERENCE TO RELATED APPLICATIONS

This is a continuation of U.S. patent application Ser. No. 15/090,780 filed on Apr. 5, 2016, which is a continuation of International Patent Application PCT/KR2014/009638 filed on Oct. 14, 2014 which designates the United States and claims priority of Korean Patent Application No. 10-2013-0121700, filed on Oct. 14, 2013, the entire contents of which are incorporated herein by reference.

FIELD OF THE INVENTION

The present invention relates to a sole for dispersing the pressure applied to a midfoot and metatarsal bones of a foot and a shoe having the same.

BACKGROUND OF THE INVENTION

Generally, a shoe serves simply to protect a wearer's foot from external environments upon his or her activities and further to provide various functions and unique designs for him or her.

The rear axis of the outer sole of the shoe is almost perpendicular to the surface of the ground, so that upon walking, excessive load and pressure are applied to the wearer's foot, thus undesirably making him or her feel easily tired.

Components constituting the foot are basically fixed to each other to perfectly conduct the functions of the foot while the body stands up and walks, and further, they have some orthopedic shapes and structures through their combinations varied in different states.

The forms taken by the foot during walking are varied according to a walking process, and in accordance with the forms taken by the foot during walking, the walking process is largely classified into four steps. For example, as a first step of walking, the heel of the foot comes into contact with the ground, and as a second step of walking, the whole portion of the foot comes into contact with the ground. As a third step of walking, the heel of the foot is raised up from the ground, and as a fourth step of walking, the forefoot of the foot pushes up from the ground. While the four steps are being periodically repeated, the walking is conducted.

First, at the first step of walking wherein the heel of the foot comes into contact with the ground, the foot forms dorsiflexion when the heel of the foot comes into contact with the ground, and at the second step of walking wherein the whole portion of the foot comes into contact with the ground, the ankle of the foot is stretched to form plantar flexion.

Next, at the third step of walking wherein the heel of the foot is raised up from the ground, the ankle is more stretched to develop the plantar flexion, so that joint portions connected between metatarsal heads and proximal phalanges are bent upward. After that, at the fourth step of walking wherein the forefoot of the foot pushes up from the ground, the toes form the plantar flexion, and the metatarsal heads and the phalanges having a given angle through the bending at the third step of walking are stretched, so that the toes push up from the ground. Next, the movement to the first step of walking is ready, and the foot forms the dorsiflexion so that it is separated from the ground. So as to gently conduct the walking at the respective steps, the components of the foot have some orthopedic shapes in their relations, and if the orthopedic shapes are not obtained well due to any problems, the walking becomes inefficient. On the other hand, an excessive pressure or force is applied to the respective portions of the foot, thus making them damaged or disabled. Further, the portions of the foot as required are not sufficiently used, thus making the functions of the foot weakened.

On the other hand, the shoe protects a foot from external heat, cold air, and damages caused by the contact with external objects and releases the impacts applied to the foot while moved. However, the shoe restricts the natural movements of the foot, thus undesirably giving bad influences to the foot.

For example, a conventional shoe outer sole is made of a hard member having a given mechanical strength so as to provide given durability to the shoe itself. In this case, the outer sole does not matter when a wearer stops walking, but when he or she walks or runs, the hard outer sole restricts the natural movements of the foot, so that a larger force than required is used, or a walking form of the foot as required is not obtained well.

Particularly, the raising of the heel of the foot at the third step of walking, that is, the deformation of the foot to take the plantar flexion is not sufficiently conducted. As mentioned above, if the deformation of the foot is not sufficiently conducted at the third step of walking, it is hard that the elasticity of the muscles is accumulated on the foot so as for the toes to push the ground at the fourth step of walking. Thus, the walking efficiency decreases.

Contrarily, if the outer sole is made of too soft material, the durability of the outer sole becomes bad and the stability of the foot becomes weak. Further, separate cost should be needed to obtain given durability according to the materials of the outer sole.

Further, an existing ready-made shoe generally has an outer sole made of an impact-absorbing elastic material so as to reduce grounding impacts during walking or running, but upon grounding, the impact-absorbing elastic material may cause instability to the left and right sides of the foot from the center of the foot according to the positions used. For example, in case of a shoe utilizing the compression of air as a cushion through the formation of an air chamber in the middle of the heel portion thereof, the instability between the left and right sides of the foot becomes severe when the heel of the foot is grounded, thus making the ankle easily damaged.

Many studies have been made to solve the above-mentioned problems. For example, Korean Utility Model Registration No. 2004540430000 (Jun. 3, 2011) discloses a shoe having a sole support, a midsole and an outer sole, wherein the shoe includes an edge formed on the sole support and having one or more bridges located on left and right sides of the forefoot and heel of the foot.

Further, Korean Utility Model Registration No. 2004681440000 (Jul. 19, 2013) discloses a functional shoe including: a midsole having a triple structure made with different hardness; a bridge extended from the top of the midsole to an outer sole and having one or more legs formed integrally with the outer sole; and a net-shaped frame formed on the upper part of the shoe to support the subtalat joint at which pronation starts, wherein the triple structure includes a first low hardness polyurethane layer, a second intermediate hardness polyurethane layer, and a third high hardness polyurethane layer. The triple structure made with the different hardness is increased in hardness it goes from the rear side to the front side. Further, the functional shoe includes a solid portion made of a polymer material to support the medial portion of the foot, and the solid portion is located over the underside and center of the medial side of the shoe.

Further, Korean Patent Application Laid-open No. 1020100042863 (Apr. 27, 2010) discloses a functional shoe that removes the load applied to a foot, while external air is being supplied to the interior of the shoe. In more detail, the load applied to the foot upon walking is released by means of an air bag and a protruding portion to decrease the fatigue of the foot, and further, as the protruding portion and the heel are changed in shape by means of the load applied to the foot, the center of weight of the body moves forward to induce natural walking. Furthermore, the internal air of the shoe is circulated to allow the interior of the shoe to be kept refresh.

Lastly, Korean Patent Application Laid-open No. 1020000036859 (Jul. 5, 2000) discloses a shoe outer sole and a manufacturing method wherein an outer sole made by molding an unvulcanized rubber sheet having prevention sheet made of a sponge sheet or a woven fabric located on top thereof; an edge midsole made by compressing and bonding a foamed and molded E.V.A. material along the top surface edge of the prevention sheet of the outer sole and having a through hole formed on the side surface thereof and a transparent window formed on the through hole in such a manner as to allow the interior of the through hole to be seen; a central midsole located at the center of the edge midsole to maintain lower hardness than the edge midsole and having a cushion member formed on one side of the interior thereof in such a manner as to be compressed and restored from impacts, wherein the medial hardness of the midsole and the lateral hardness of the midsole are different from each other, and the cushion member is adapted to be compressed and restored from the impacts applied to the midsole in such a manner as to be visually checked through the transparent window.

SUMMARY OF THE INVENTION

Technical Problem

Accordingly, the present invention has been made in view of the above-mentioned problems occurring in the prior art, and it is an object of the present invention to provide a midsole and a shoe having the midsole that is capable of reducing toe pain during walking for a long period of time caused by congential malformations of a foot and bad walking types, thus enhancing the conveniences of the walking.

Technical Solution

The present invention, to accomplish the above-mentioned object, provides an improvement to "a shoe sole with an attachment and a shoe having the same" as disclosed in Korean Patent Application No. 10-2009-38941 filed by the same applicant.

The present invention provides a midsole for dispersing pressure of a midfoot and metatarsal bones and a shoe having the same, the midsole including: a midfoot support disposed protruding upwardly from the top of the center of a midsole to support the midfoot of the foot; and a bridge part insertedly mounted into a bridge groove formed on the center of the underside of the midsole and having three components so as to support the metatarsal bones and the joints between the metatarsal bones and phalanges of the foot.

Advantageous Effects

According to the present invention, the midsole can support the joints between metatarsal bones and phalanges of the foot and can disperse the pressure of the midfoot and metatarsal bones of the foot to minimize the pressure applied to toes of the foot, thus releasing the toe pain caused by toe malformations during walking, allowing the shape of the foot upon walking to be more naturally taken, enhancing walking efficiencies, and preventing various pains and diseases caused by walking.

BRIEF DESCRIPTION OF THE DRAWINGS

FIGS. 5A to 5C are sectional views showing various examples of a bridge part disposed in the midsole according to the present invention, wherein FIG. 5A shows the bridge part protruding from the center thereof, FIG. 5B shows the bridge part protruding from the front side thereof, and FIG. 5C shows the bridge part protruding from the rear side thereof.

FIGS. 6A and 6B are plan and front views showing a midfoot support of the midsole according to the present invention.

FIGS. 7A to 7D are sectional views showing various examples of the midfoot support of the midsole according to the present invention, wherein FIG. 7A shows a flat type midfoot support, FIG. 7B shows a midfoot support whose uppermost portion is at the center thereof, FIG. 7C shows a midfoot support whose the uppermost portion is at the front side thereof, and FIG. 7D shows a midfoot support whose the uppermost portion is at the rear side thereof.

EXPLANATION ON THE REFERENCE NUMERALS IN THE DRAWINGS

Figure 1:
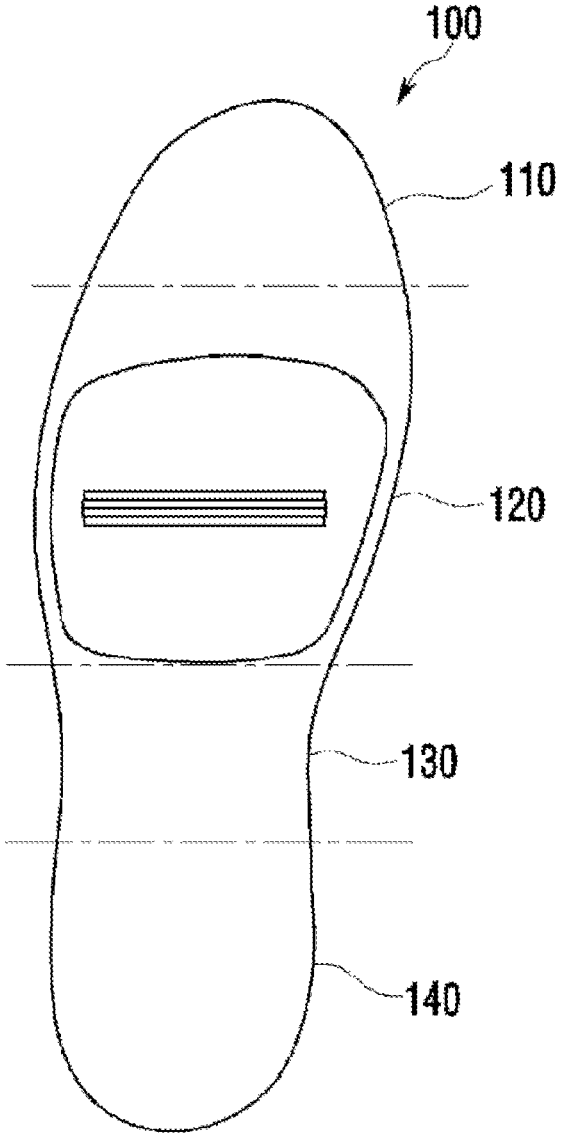
FIG. 1 is a bottom view showing a midsole for dispersing the pressure applied to a midfoot and metatarsal bones of a foot according to the present invention.

Midsole (100), toe portion (110), metatarsal bone portion (120), midfoot portion (130), rearfoot portion (140), bridge groove (190), midfoot support (200), bridge part (300), first buffering member (310), second buffering (and slipping-preventing) member (320), underside center-protruding portion (321), bridge body (330), underside center-protruding portion through hole (331), outer sole (500), outer sole through hole (510), and heel (600)

DETAILED DESCRIPTION OF THE INVENTION

So as to solve the above-mentioned problems, the present invention relates to a midsole for dispersing the pressure applied to a midfoot and metatarsal bones of a foot, and a shoe having the same, wherein the midsole includes a midfoot support disposed protruding upwardly from the tops of a metatarsal bone portion and a midfoot portion formed on the center thereof to support the midfoot of the foot; and a bridge groove formed on the underside of the metatarsal bone portion to insertedly mount a bridge part thereinto.

The bridge part consists of three components so as to support the metatarsal bones and the joints between the metatarsal bones and phalanges of the foot.

According to the present invention, the midfoot support is disposed protruding upwardly from the top of the center of the midsole in such a manner as to accommodatedly receive the inner sole thereonto and support the midfoot of the foot, and when seen from a plane view thereof, the midfoot support has a shape of generally reversed trapezoid in which a front end side and a rear end side are convex forward like an arch and the front end side is longer than the rear end side when viewed in plane of the midsole.

Further, the bridge groove is formed on one side of the center of the underside of the midsole, and the bridge part is insertedly mounted into the bridge groove in such a manner as to pass through an outer sole through hole formed at the center of an outer sole.

The bridge part consists of three components so as to support the metatarsal bones and the joints between the metatarsal bones and the phalanges of the foot.

The three components of the bridge part are a first buffering member having a shape of a rectangular parallelepiped in such a manner as to be partially inserted into the bridge groove; a second buffering member, which is capable of providing buffering and slipping-preventing functions and located on the underside of the first buffering member and having a flat rectangular upper portion and a square pillar portion extending downwardly from the flat upper portion so as to have a shape of "T" when viewed from the front portion of the midsole; and a bridge body having a groove as to accommodate the first buffering member and the second buffering member and an through hole formed at a bottom of the groove in such a manner as to receive the square pillar portion through the through hole.

In more detail, the first buffering plate 310 has a shape of a rectangular parallelepiped having a thickness of 1 to 10 mm, and the second buffering and slipping-preventing member 320 is located on the underside of the first buffering member and has a thickness of 20 to 35 mm. Further, the bridge body 330 has an underside center-protruding portion through hole having a depth of 0.2 to 30 mm formed at the bottom of the groove in such a manner as to pass an underside center-protruding portion therethrough.

The midfoot support may have four shapes. In accordance with the shapes of a user's foot, upwardly protruding angles of the midfoot support can be classified. When viewed from the front thereof, the midfoot support may be a flat type shown in FIG. 7A having a flat top side (flat top plane in a three dimensional view), a mid-high convex type shown in FIG. 7B having a convex top side whose uppermost portion is at the center thereof, a front-high convex type shown in FIG. 7C having a convex top side whose uppermost portion is at the front portion thereof, and rear-high convex type shown in FIG. 7D having a convex top side whose uppermost portion is at the rear portion thereof.

The bridge part may have three types in accordance with the shapes of the user's foot. For example, the bridge part may be a medial portion protruding type shown in FIG. 5A protruding from the center of the bridge part, a front portion protruding type shown in FIG. 5B protruding from the front side (front portion) of the bridge part, and a rear portion protruding type shown in FIG. 5C protruding from the rear side of the bridge part In a point of view, the bridge part includes a buffering portion, a through hole portion and a bridge body.

A shoe having the midsole according to the present invention is provided with an outer sole having an outer sole through hole formed at the center thereof to pass the bridge part of the midsole therethrough, and the position of the outer sole through hole corresponds to the metatarsal bone portion of the outer sole.

According to the present invention, in case of a women's high-heeled shoe, the bridge part is extended to a midfoot portion located behind the metatarsal bone portion, and when the bridge part is viewed in the state of being cut along a longitudinal axis of a foot, the rear side of the bridge part is thicker than the front side thereof. Further, there is a heel located on the rearfoot portion corresponding to the heel of the foot, and the heel, which is brought into contact with the ground, has a width of 3 cm or less in medial and lateral directions. Further, stability columns, which protrude at medial side and at lateral side, may be formed on the extended portion of the bridge part to the midfoot portion.

According to the present invention, the bridge part is made of an elastic material being soft and having strong restitutive force. The elastic material is selected from rubber, EVA (Ethylene Vinyl Acetate) foam, polyurethane resin, or the like only if the pressed portion may be contracted much more than the neighboring portions when pressed, so that the metatarsal bone portion can be surrounded with the elastic material.

Further, the elastic material may be capable of performing shape memory. The bridge part is made of the elastic material, and when a given pressure is applied to a point of the bridge part, accordingly, the given pressure is dispersed evenly to the place at which the elastic material is located, while being not concentrated on the specific point of the metatarsal bone portion, thus performing the buffering action against the given pressure.

Hereinafter, an explanation on the midsole for dispersing the pressure applied to the midfoot and metatarsal bones of the foot according to the present invention will be in detail given with reference to the attached drawings.

FIG. 1 is a bottom view showing a midsole according to the present invention.

Anatomically, a foot is divided into three portions like a forefoot, a midfoot, and a rearfoot (hindfoot) by Chopart joint and Lisfranc joint. In case of the midsole of a shoe, however, the forefoot is divided into a toe portion and a metatarsal bone portion by means of metatarsophalangeal joint (MP joint), and accordingly, the midsole is conveniently divided into four portions like a rearfoot portion 140, a midfoot portion 130, a metatarsal bone portion 120 of the forefoot, and a toe portion 110 of the forefoot.

According to the present invention, for the sake of convenience, the midsole is divided into four portions from the front side thereof to the rear side thereof by means of vertical lines to the longitudinal axis of the foot.

Figure 2:
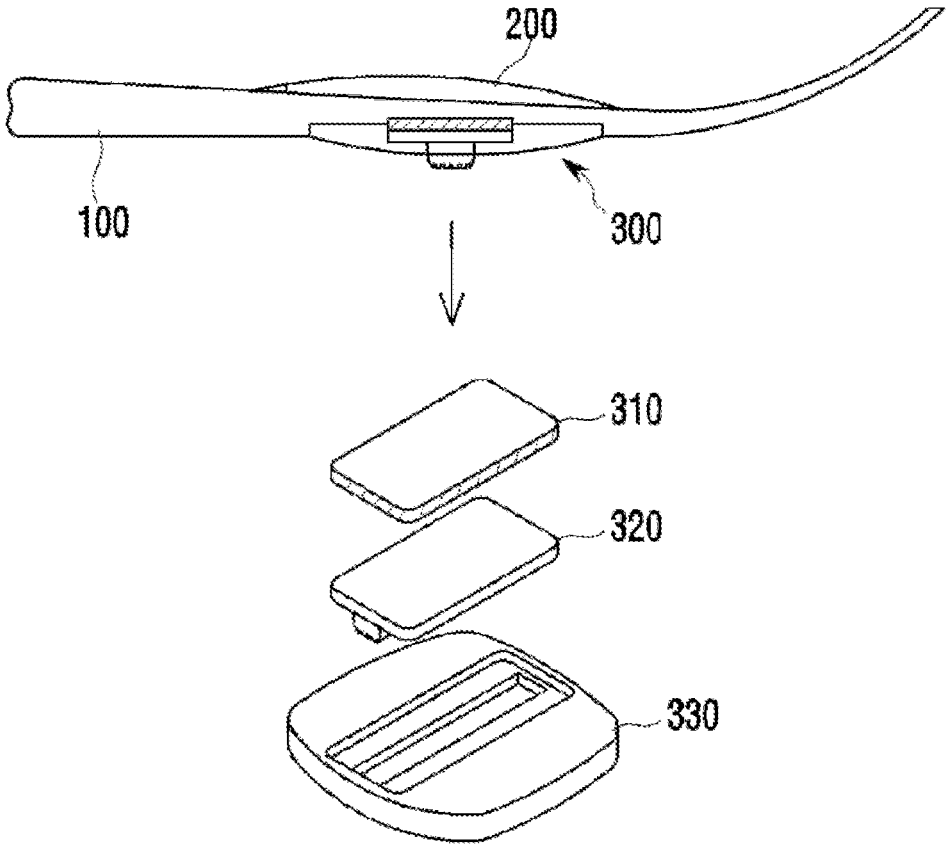
FIG. 2 shows a longitudinal sectional view showing the midsole according to the present invention and perspective deal drawing of the bridge part.
Figure 3:
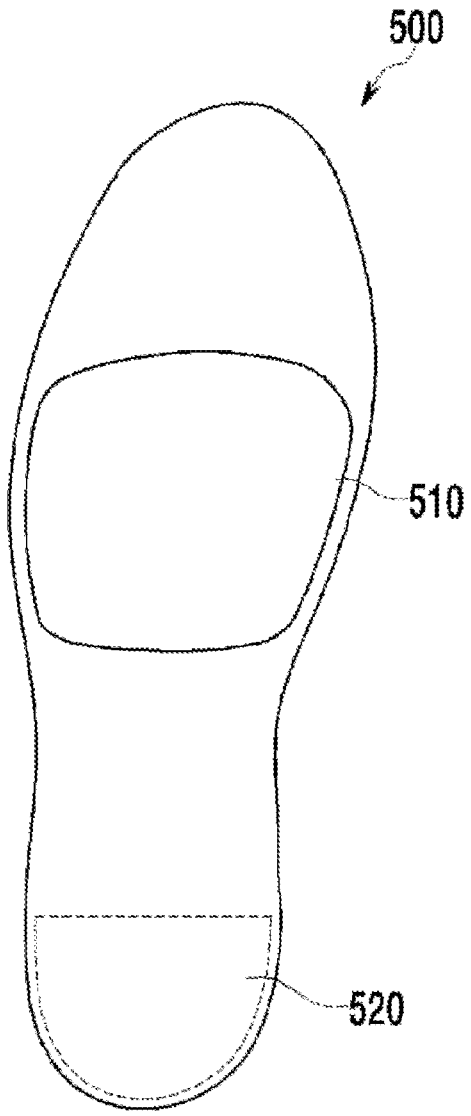
FIG. 3 is a bottom view showing an outer sole coupled to the midsole according to the present invention.
Figure 4:
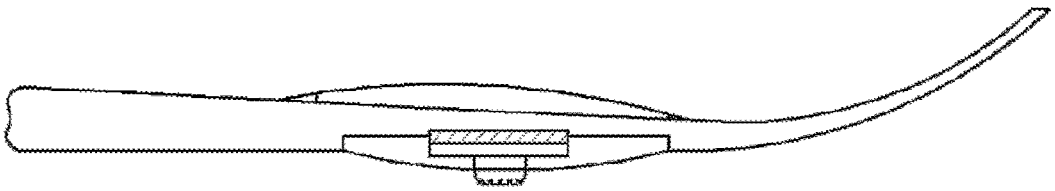
FIG. 4 is a sectional view showing the outer sole coupled to the underside of the midsole according to the present invention.

As shown in FIG. 2, the midsole according to the present invention has the bridge groove formed on the center of the underside thereof and the bridge part mounted into the bridge groove. The bridge part consists of three components. Each of the components is attached to the body of the midsole by means of an adhesive. The bridge part is generally made of a different material from the body of the midsole.

That is, the material and shape of the bridge part can be different from those of the body of the midsole.

Since the metatarsal bone portion has a portion on which a pressure is concentrated at the third walking step, the bridge part is desirably made of a tough material so that it is not easily worn out even if the pressure is applied thereto. However, the bridge part is made to be bent easily with a relatively smaller force than that applied to the body of the midsole to be bent, so that it is easy to raise the heel of the foot at the third walking step. Further, the bridge part has a protrusion formed at a portion coming into contact with the ground.

Figure 8:
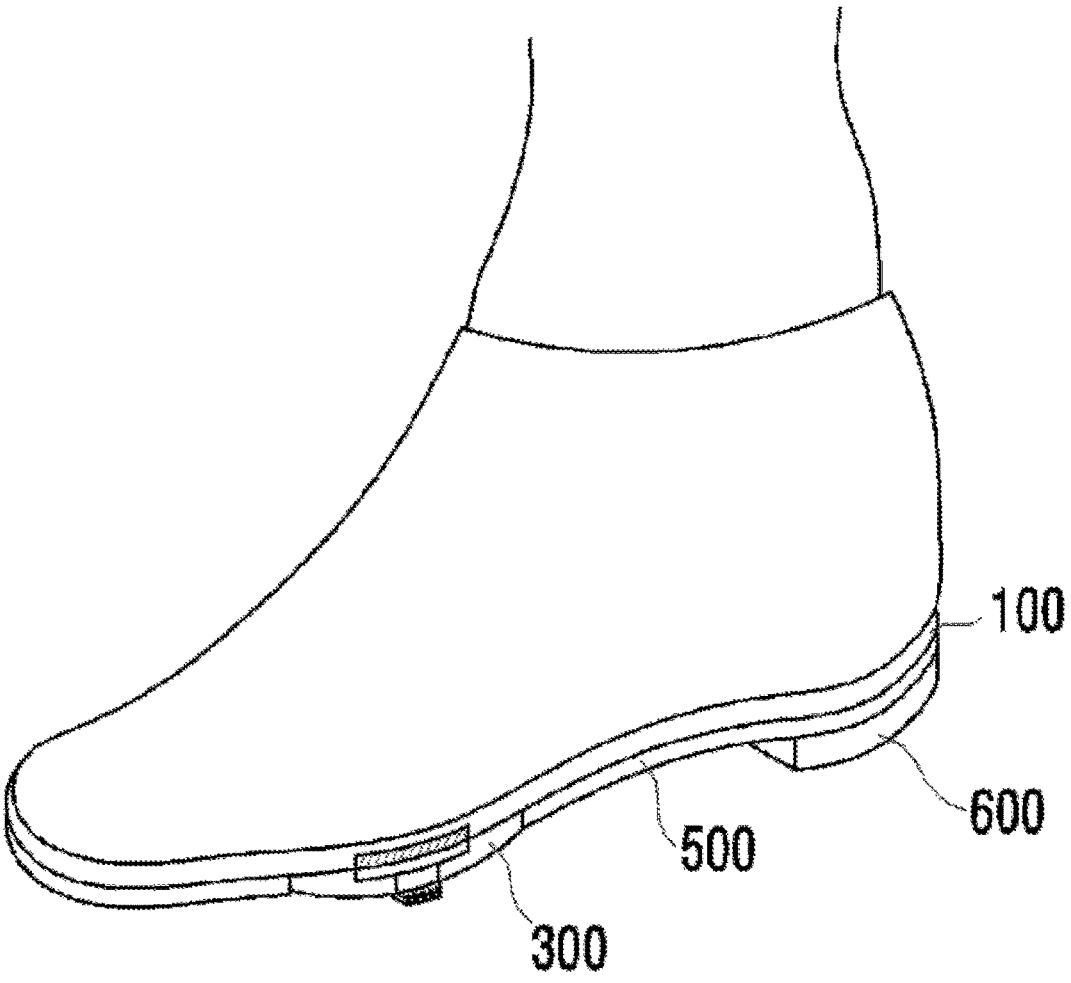
FIG. 8 is a perspective view showing a shoe having the midsole according to the present invention.

FIG. 8 is a perspective view showing a shoe according to the present invention.

Referring to FIGS. 1, 2, 3 and 8, the midsole 100 is located on top of the outer sole 500, and a heel 600 is located on the rear side of the outer sole 500. The outer sole 500 has an outer sole through hole 510 formed at the center thereof.

The midsole 100 includes a midfoot support 200 located on top thereof, a bridge groove 190 formed on the underside of the center thereof, and a bridge part 300 located on the bridge groove 190 in such a manner as to pass through the outer sole through hole 510 of the outer sole 500.

The bridge part 300 includes a first buffering member 310 having a thickness of 1 to 10 mm in such a manner as to be partially inserted into the bridge groove 190, a second buffering member 320 (capable of buffering and slipping-preventing function) having a planar portion and a downward protruding portion to form a generally "T" shape and having a thickness of 20 to 35 mm in such a manner as to be located on the underside of the first buffering member 310, and a bridge body 330 adapted to accommodate the first buffering plate 310 and the second buffering member 320 thereinto and having a through hole formed on the center thereof in such a manner as to receive the downward protruding portion of the second buffering member therethrough, the underside center-protruding portion through hole 331 having a thickness of 0.2 to 30 mm.

The midfoot support 200 is made of a buffering material or an elastic material, like rubber, EVA (Ethylene Vinyl Acetate) foam, polyurethane resin, etc. and situated around the metatarsal head of the metatarsal bone portion.

When the bridge part 300 is viewed in the state of being cut along the longitudinal axis of a foot, the rear side of the bridge part 300 is thicker than the front side thereof, and the high thickness is maintained up to the end portion of the rear side of the bridge part 300. A general portion of the bridge part 300 is convexed downwardly like a streamlined shape seen in the cut-off surface of the wing of an aircraft. Accordingly, the bridge part 300 forms the curved underside of the metatarsal bone portion of the forefoot, which can be called forefoot rocker.

The heel 600 is located on the outer sole 500 corresponding to the rearfoot portion 140 at which the heel of the foot is placed. The heel 600 may be a Thomas heel, and the formation of the heel 600 may allow the foot to perform supination after the heel of the foot comes into contact with the ground at the first step of walking.

In case that the medial side of the heel 600 is more extended to the front side thereof than the lateral side thereof to form an extension portion, so that as the whole portion of the foot comes into contact with the ground at the second step of walking after the heel of the foot comes into contact with the ground, the foot on the midfoot portion 130 is naturally inclined to the lateral side of the midfoot portion 130 having no heel, thus naturally conducting the supination.

Now, an explanation on the actions taken while a wearer who wears the shoe having the midsole according to the present invention as shown in FIGS. 1 and 2 is walking will be given.

Referring first to natural working patterns by a bare foot, the foot walking is conducted in a flapping way so that the foot moves from the lateral side to the medial side. Accordingly, the consumption of energy upon walking is reduced, thus making it possible to keep the walking for a long period of time.

In the flapping walking, the lateral edge of the foot first comes into contact with the ground, and next, the whole sole of the foot is contacted with the ground. After that, the heel of the foot is separated from the ground, and then, a walker's weight is applied to the toes of the foot to allow the toes of the foot to push the ground. That is, until the whole sole of the foot comes into contact with the ground after the heel of the foot has been brought into contact with the ground, the movement from the supination (the medial side of the sole of the foot is raised up and rotated outward from the walker's body) to the pronation (the lateral side of the sole of the foot is raised up and rotated inward from the walker's body)is conducted, and contrarily, until the toes of the foot push the ground after the whole sole of the foot has been brought into contact with the ground, the movement from the pronation to the supination is conducted.

By the way, the conventional shoe outer sole has a horizontal underside surface, and when the whole sole of the foot comes into contact with the ground after the heel of the foot has been brought into contact with the ground, it may frequently come into contact with the ground, without having any lateral edge being contacted with the ground, so that the supination movement, through which the lateral edge of the foot is first contacted with the ground before the medial side of the foot, cannot be gently conducted, and accordingly, natural walking by the bare foot cannot be obtained, thus undesirably increasing the fatigue of the foot and lowering the walking efficiencies.

If the shoe outer sole according to the present invention is adopted, at the first step of walking the heel of the foot comes into contact with the ground in the state where the foot forms dorsiflexion. Further, a buffering material (not shown) is located with a shape of a wedge at the rear end of the rearfoot portion 140 corresponding to the heel of the foot, thus releasing the impacts generated at the grounding step.

Next, at the second step of walking the ankle of the foot is stretched out from the dorsiflexion of the foot so that the foot forms plantar flexion to allow the whole portion of the foot to come into contact with the ground. At this time, the outer sole of the shoe is not just flat, but has the heel 600 located on the rearfoot portion 140. Especially, the heel 600 is formed of a Thomas heel so that the medial side of the heel 600 is extended by 1 to 1.5 cm to the front side thereof. Accordingly, at the step where the whole portion of the foot comes into contact with the ground, the thickness on the medial side of the midfoot portion of the outer sole becomes high and the thickness on the lateral side thereof becomes low by means of the Thomas heel.

Accordingly, the foot is inclined laterally to allow the lateral side of the foot to be brought into contact with the ground, thus providing the supination movement.

So as to conduct the forward walking, without being turned laterally, however, it is not desirable that the supination movement is too developed.

The development of the supination movement applies a lot of loads to the muscles of the sole of the foot suppressing the height of the medial longitudinal arch of the foot from being too decreased upon the change to the pronation movement.

According to the present invention, therefore, if the foot coming into contact with the ground reaches the front end of the midfoot portion 130 or the metatarsal bone portion 120 after the supination movement, the rear side of the bridge part 300 is high in thickness and the lateral side of the bridge part 300 is extended toward the rear side on the midsole, so that at the initial process of the third step of walking the foot is inclined to the medial side on which the midsole is low in thickness to allow the supination state to be naturally changed to the pronation state through the thickening of the midsole by the rear end portion of the lateral side of the bridge part 300.

Next, at the third step of walking the heel of the foot is raised up to allow the walker's weight to be concentrated on the metatarsal bone portion, especially, the metatarsal head, thus increasing the angles between the metatarsal bones and the phalanges of toes connected to the metatarsal bones. At this time, a portion of the metatarsal bone portion of the midsole being generally hard and difficult to be bent is removed, and the easily bendable bridge part 300 is located at the portion of the metatarsal bone portion of the midsole, so that as the heel of the foot is raised up, the midsole increases the angles between the metatarsal bones and the phalanges of toes, thus reducing a resistance generated from the shoe.

Moreover, the soft and elastic midfoot support is located on top of the midsole to disperse and release the pressure applied to the metatarsal head. The midfoot support serves to allow the metatarsal head to move more downward at the step of raising up the heel of the foot, thus increasing the angles between the metatarsal bones and the phalanges of toes. Further, the development of the plantar flexion for next step is more easily conducted to increase the walking efficiencies.

Next, at the step of forefoot pushing as the fourth step of walking, the toes form a small arch, and then, the metatarsal bones and the phalanges of toes having the given angles therebetween at the third step of walking are stretched out, so that the toes push backward from the ground. After that, while the movement to the first step of walking is being ready, the foot forms the dorsiflexion so that it is separated from the ground.

Since the plantar flexion is developed, the forefoot can push up from the ground more efficiently through the elasticity of the muscles accumulated on the foot.

Further, the metatarsal bones of the foot is push up by the restoring force of the elastic energy accumulated on the compressed elastic material, so that at the step wherein the toes push the ground, the shape of the foot is formed to be easily pushed up by the forefoot under the principle of the lever, and on the other hand, the foot easily forms the dorsiflexion to conduct the first step of walking as a next step.

At this time, since the pronation movement is conducted at the third step of walking, the medial side (great toe) of the foot generally pushes the ground at the fourth step of walking, so that the foot is changed from the pronation state to the supination state according to the action of the midsole dispersing the pressure applied to the midfoot and the metatarsal bones of the foot.

According to the present invention, through the four steps of walking, through the process from the grounding to the kicking the ground, the change from the supination to the pronation and the change from the pronation to the supination are performed, which is similar to the natural walking of the bare foot.

According to the present invention, however, the change from the pronation to the supination and the change from the supination to the pronation are conducted through the structure of the midsole of the shoe, so that the load in the change can be reduced when compared with the change by the foot itself, and especially, load applied to the foot can be decreased while a walker having weak foot muscles is walking.

Figure 5A:
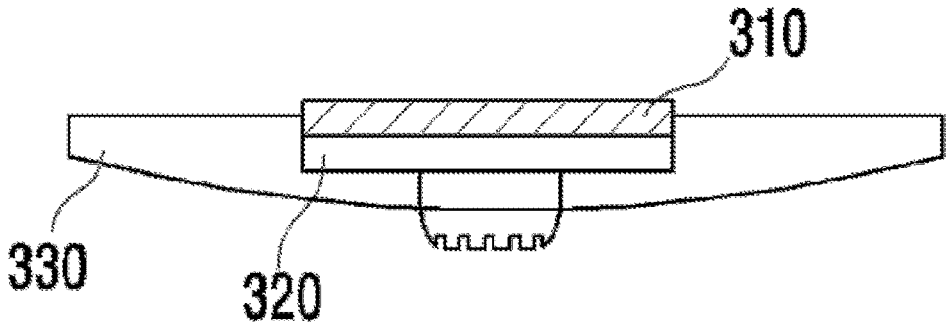
Figure 5B:
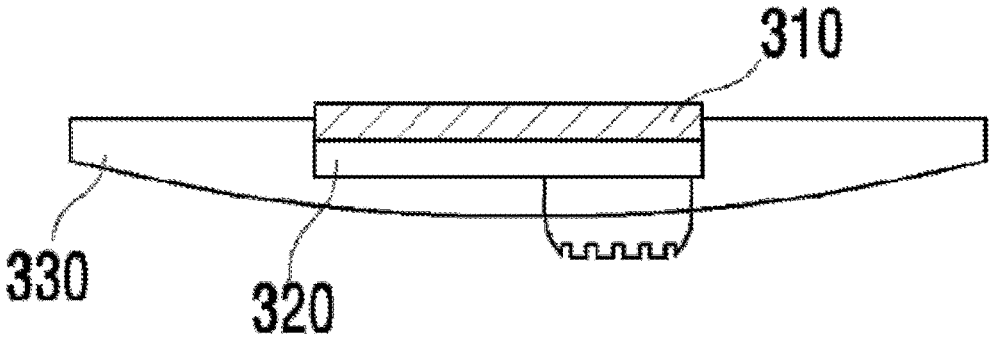
Figure 5C:
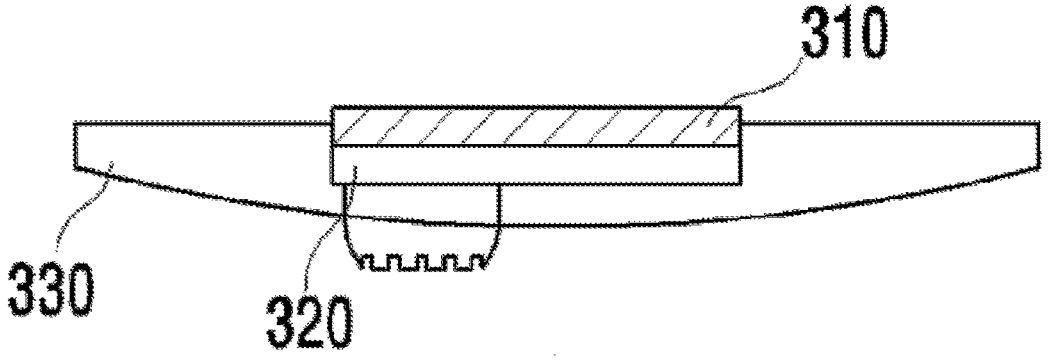

FIGS. 5A to 5C show various examples of the bridge part formed in the midsole according to the present invention. FIG. 5A shows the bridge part protruding from the center thereof, FIG. 5B shows that protruding from the front side thereof, and FIG. 5C shows that protruding from the rear side thereof.

FIGS. 7A to 7D show various examples of the midfoot support according to the present invention.

Figure 7C:
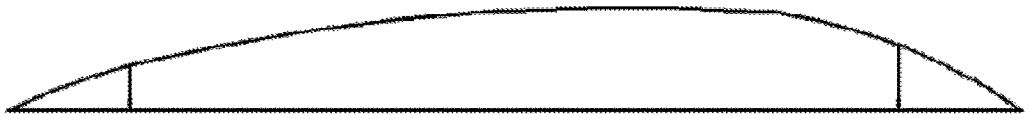
Figure 7D:
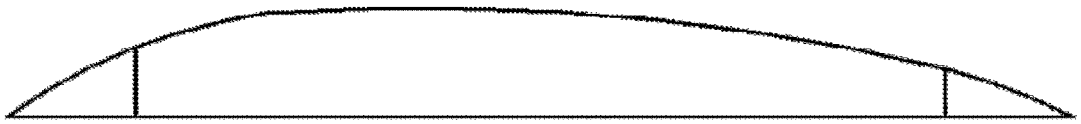

FIG. 7A shows a flat type midfoot support, FIG. 7B shows a midfoot support whose uppermost portion is at the center thereof, FIG. 7C shows a midfoot support whose uppermost portion is at the front side thereof, and FIG. 7D shows a midfoot support whose uppermost portion is at the rear side thereof.

They are selectively adopted in accordance with the shapes of the walker's foot, and at this time, the adoption is conducted through the accurate prescription of a doctor.

Figure 6A:
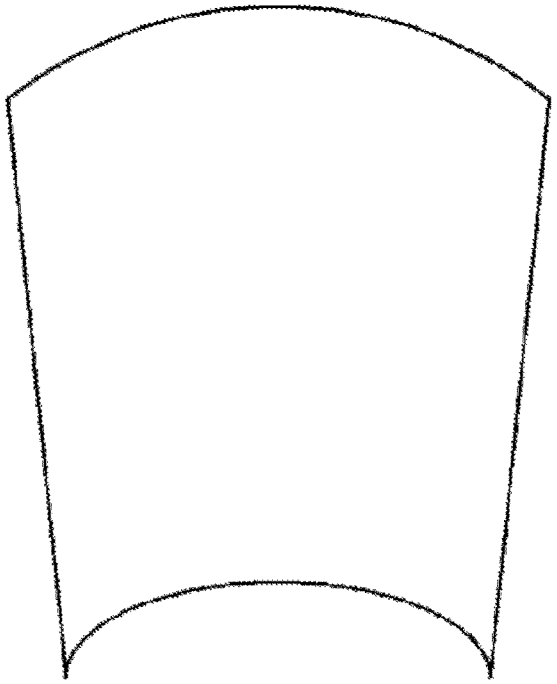

FIGS. 6A and 6B are plan view and front view showing a midfoot support of the midsole according to the present invention.

The midfoot support 200 disposed in the midfoot portion and metatarsal bones portion at the center of the top portion thereof and having a shape of reversed trapezoid in which a front end side and a rear end side are convex forward like an arch and the front end side is longer than the rear end side, the width between the two lateral side increase along the longitudinal direction to the front end when viewed in plane of the midsole and having a convex top side whose uppermost portion is at the center thereof when viewed from the front portion of the midsole.

The bridge part and the midfoot support may be used optionally or selectively in accordance with the shapes of the user's foot, and at this time, the usage is conducted through the accurate prescription of a doctor.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A sole for a shoe for dispersing the pressure applied to a midfoot and metatarsal bones of the foot to reduce a potential pain during walking while enhancing comfortability to the foot wearing the shoe, the sole comprising:

a midfoot support adapted to be disposed over a metatarsal bone portion and a midfoot portion and having a shape of reversed trapezoid in which a front end side is longer than a rear end side thereof; and a bridge part including at least one buffering member formed of an elastic material for providing cushioning and slipping-preventing functions to the shoe, a distal end of the buffering member having a pillar portion extending downwardly to expose from a bottom surface of the sole through a through hole formed in a midfoot or metatarsal bone area of the sole, wherein the bridge part comprises:

a first buffering member having a shape of a rectangular parallelepip, the first buffering member formed of elastic material and at least partially inserted into a bridge groove formed in the midfoot or metatarsal bone area of the sole;

a second buffering member, formed of elastic material for providing the cushioning and slipping-preventing functions to the shoe and located on the underside of the first buffering member and having a flat rectangular upper portion and the pillar portion extending downwardly to expose from the bottom surface of the sole so as to have a shape of "T"; and a bridge body having a groove so as to accommodate the first buffering member and the second buffering member, wherein the through hole formed at a bottom of the groove in such a manner as to receive the pillar portion through the through hole of the sole.

2. The sole according to claim 1, wherein the midfoot support has a shape selected from a flat type having a generally flat top surface, a mid-high convex type having a convex top surface whose uppermost portion is at the center thereof, a front-high convex type having a convex top surface whose uppermost portion is at the front portion thereof, and rear-high convex type having a convex top surface whose uppermost portion is at the rear portion thereof.

3. The sole according to claim 1, wherein the bridge part has a shape selected from a medial portion protruding type protruding from the center of the bridge part, a front portion protruding type protruding from a front side of the bridge part, and a rear portion protruding type protruding from a rear side of the bridge part.

4. A shoe having the midsole according to claim 1;

an insole placed on the sole; and an outsole placed under the sole and having an outer sole through hole being passed through by the bridge part.

5. The sole according to claim 1, wherein the midfoot support and the bridge part are formed of an elastic material selected from rubber, EVA (Ethylene Vinyl Acetate) foam, or polyurethane resin.

6. The sole according to claim 1, wherein a bottom surface of the pillar portion has a plurality of laterally directed protrusions configured to provide the slipping-preventing functions to the shoe.

7. The sole according to claim 1, wherein the midfoot has the reversed trapezoid shape in which the front end side and the rear end side each have a convex contour protruding in a forward direction of the shoe.

* * * * *